US011412844B1

(12) United States Patent
Tham

(10) Patent No.: US 11,412,844 B1
(45) Date of Patent: Aug. 16, 2022

(54) TABLE ASSEMBLY

(71) Applicant: Noble House Home Furnishings, LLC, Chatsworth, CA (US)

(72) Inventor: Siew Kin Tham, Chatsworth, CA (US)

(73) Assignee: NOBLE HOUSE HOME FURNISHINGS LLC, Chatsworth, CA (US)

( * ) Notice: Subject to any disclaimer, the term of this patent is extended or adjusted under 35 U.S.C. 154(b) by 0 days.

(21) Appl. No.: 16/749,887

(22) Filed: Jan. 22, 2020

Related U.S. Application Data

(60) Provisional application No. 62/796,211, filed on Jan. 24, 2019.

(51) Int. Cl.

| | |
|---|---|
| ***A47B 13/00*** | (2006.01) |
| ***A47B 96/20*** | (2006.01) |
| ***A47B 13/02*** | (2006.01) |
| ***A47B 13/08*** | (2006.01) |

(52) U.S. Cl.
CPC ..... *A47B 13/003* (2013.01); *A47B 13/02* (2013.01); *A47B 13/08* (2013.01); *A47B 96/205* (2013.01)

(58) Field of Classification Search
CPC ..... A47B 13/003; A47B 13/02; A47B 13/08; A47B 96/205; A47B 13/04; A47B 47/0083; A47B 47/0058; A47B 3/0918; B25H 1/04; B25H 1/06; F16M 13/00; F16B 9/00; F16B 9/09; F16B 9/023; F16B 9/05; F16B 9/07; F16B 12/44; F16B 12/48; A47F 3/004; A47F 3/0018; A47F 5/10
USPC ..... 108/158.12, 115, 153.1, 155, 157.1, 108/157.18, 159, 154, 157.16, 158.13; 182/181.1, 129; 144/286.1, 286.5
See application file for complete search history.

(56) References Cited

U.S. PATENT DOCUMENTS

| | | | | | |
|---|---|---|---|---|---|
| 1,909,223 | A | * | 5/1933 | Roos | A47B 3/00 108/99 |
| 2,086,463 | A | * | 7/1937 | Bram | A47B 3/0917 108/65 |
| 2,255,791 | A | * | 9/1941 | Klopfer | A47D 7/002 5/93.1 |
| 2,573,740 | A | * | 11/1951 | Spikings, Jr. | B25H 1/06 182/155 |
| D189,510 | S | * | 12/1960 | Tissot | D6/708.16 |
| 3,170,418 | A | * | 2/1965 | Gruenstein | A47F 5/14 108/101 |
| 4,709,642 | A | * | 12/1987 | Briosi | F16B 12/32 108/187 |
| 4,756,384 | A | * | 7/1988 | Maddox | B25H 1/06 116/63 P |
| 5,257,701 | A | * | 11/1993 | Edelson | A47B 3/10 108/116 |

(Continued)

FOREIGN PATENT DOCUMENTS

DE 202019001594 * 9/2019

OTHER PUBLICATIONS

KR 2016090598 abstract and figure (Year: 2016).*

*Primary Examiner* — Janet M Wilkens
(74) *Attorney, Agent, or Firm* — Colin P. Abrahams

(57) ABSTRACT

A table assembly comprises a table top having an upper surface, a lower surface, and first and second ends. A table frame comprises a pair of first and second lateral frame structures for respectively receiving the first and second ends of the tabletop. Further, a securing post extending between the first and second lateral frame structures.

17 Claims, 11 Drawing Sheets

(56) References Cited

U.S. PATENT DOCUMENTS

| | | | | | |
|---|---|---|---|---|---|
| 5,303,755 | A * | 4/1994 | Poling | B25H 1/0021 | 144/1.1 |
| 5,553,551 | A * | 9/1996 | Crombie | A47F 5/10 | 108/181 |
| 5,622,463 | A * | 4/1997 | Testa | B23D 61/003 | 182/129 |
| 5,868,185 | A * | 2/1999 | Poling | B23D 45/027 | 108/11 |
| 6,298,946 | B1 * | 10/2001 | Yemini | B25H 1/06 | 182/153 |
| 6,425,646 | B1 * | 7/2002 | Andrews | A47F 3/004 | 108/92 |
| 7,240,705 | B2 * | 7/2007 | Alger | A47B 3/087 | 144/286.5 |
| 8,887,932 | B2 * | 11/2014 | Sabounjian | A47B 47/0083 | 211/186 |
| 9,833,066 | B2 * | 12/2017 | Hsu | A47B 96/021 | |
| 2005/0199443 | A1 * | 9/2005 | Slavich | B25H 1/04 | 182/153 |
| 2015/0014263 | A1 * | 1/2015 | Lo | A47B 47/024 | 211/182 |
| 2015/0082612 | A1 * | 3/2015 | Wilson | B25H 1/06 | 29/559 |
| 2020/0008577 | A1 * | 1/2020 | Lim | A47B 96/063 | |

* cited by examiner

Dining Table, Box Wood
(2250x1010x2032mm) L88.58" x W39.76" x H80"
L2330 X 610 X 235 mm L91.73" x W24.01" x H9.25"

I/ DIMENSION

| No. | Description | Qty. | Thic k-ness | Width | Dimension | | | Vol m |
|---|---|---|---|---|---|---|---|---|
| | | | | | Length | | | |
| | | | | | Length | Tenson | Total | |
| **I** | **Wooden Part** | | | | | | | 0.000000 |
| 1. | Lamination leg to 50x50 | 8 | 25 | 50 | 50 | 2,098 | 2,148 | 0.021480 |
| 2. | Frame corner | 2 | 26 | 50 | 50 | | 50 | 0.000130 |
| 3. | Frame connection 1 | 2 | 30 | 50 | 1,010 | | 1,010 | 0.003030 |
| 4. | Frame connection 2 | 2 | 30 | 36 | 770 | | 770 | 0.001663 |
| 5. | Frame connection 3 | 2 | 30 | 36 | 570 | | 570 | 0.0012331 |
| 6. | Frame connection 4 | 2 | 30 | 36 | 379 | | 379 | 0.000819 |
| 7. | Table top support | 4 | 25 | 150 | 150 | | 150 | 0.002250 |
| 8. | Finger-joint table top slat | 8 | 12 | 122 | 2,200 | | 2,200 | 0.025766 |
| 9. | Table top frame (short) | 16 | 30 | 122 | 50 | | 50 | 0.002928 |
| 10. | Table top frame (long) | 4 | 30 | 30 | 2,200 | | 2,200 | 0.007920 |
| 11. | Table top slat connection 1 | 4 | 22 | 60 | 473 | 17 | 490 | 0.002587 |
| 12. | Table top slat connection 2 | 10 | 30 | 30 | 443 | 34 | 477 | 0.004293 |
| 13. | Table top connection | 2 | 30 | 30 | 500 | | 500 | 0.000900 |
| 14. | Table top slat connection 3 | 2 | 22 | 60 | 2,056 | | 2,056 | 0.005428 |
| 15. | Wooden dowel | 8 | 30 | 45 | 60 | | 60 | 0.000648 |
| 16. | | | | | | | | 0.000000 |
| **II** | **Steel Frame** | | | | | | | |
| a | Steel frame 25x50x1.1mm | 1 | 25 | 50 | 2,250 | | | 0.000000 |
| b | | | | | | | | 0.000000 |
| c | | | | | | | | 0.000000 |
| | | | | | | | | **0.081073** |

FIGURE 12

| Part | No | Description | Qty | Thickness | Width | Length | Tenon | BIM Vol | CHI THICH |
|---|---|---|---|---|---|---|---|---|---|
| | A | Wooden part | | | | | | | |
| | | Table top | | | | | | | |
| Table top | 1 | Table top slat | 8 | 15 | 115 | 2200 | | 0.03036 | |
| | 2 | Table top slat support 1 | 2 | 20 | 115 | 2200 | | 0.01012 | |
| | 3 | Table top slat support 2 | 16 | 20 | 115 | 100 | | 0.00368 | |
| | 4 | Table frame 1 | 4 | 25 | 40 | 2080 | | 0.00832 | |
| | | Table frame 2 | 2 | 25 | 40 | 2030 | | 0.00406 | |
| | | Table frame 3 | 4 | 20 | 40 | 424 | | 0.00136 | |
| | | Table top connection 1 | 8 | 20 | 40 | 440 | | 0.00282 | |
| | | Vol | | | | | | | |
| | | Leg | | | | | | | |
| Leg | | Leg | 4 | 60 | 60 | 2067 | | 0.02976 | |
| | | Connection 1 | 2 | 25 | 60 | 893 | | 0.00268 | |
| | | Connection 2 | 2 | 25 | 60 | 710 | | 0.00213 | |
| | | Connection 3 | 2 | 25 | 60 | 534 | | 0.00160 | |
| | | Connection 4 | 2 | 25 | 60 | 363 | | 0.00109 | |
| | | Top block | 2 | 53 | 53 | 83 | | 0.00047 | |
| | | Corner | 2 | 22 | 50 | 862 | | 0.00190 | |
| | | Vol | | | | | | | |
| | | Steel | | | | | | | |
| | 1 | Top frame | 1 | 20 | 40 | 2250 | | | |
| | 2 | Table top frame | 4 | 2 | 50 | 2030 | | - Anti bending | |

FIG. 13

TABLE ASSEMBLY

CROSS-REFERENCE TO RELATED APPLICATIONS

This application claims the benefit of U.S. Provisional Patent Application No. 62/796,211 filed Jan. 24, 2019, the contents of which are incorporated herein in their entirety.

FIELD AND BACKGROUND OF THE INVENTION

This invention relates to a table assembly. The invention further relates to a table comprising a usable surface, frame supports upon which the usable surface may be mounted, and connectors for releasably connecting the usable surface to the frame supports. The invention relates to a table and table assembly which can be selectively constructed and deconstructed, to facilitate easy transportation and storage.

SUMMARY OF THE INVENTION

According to one aspect of the invention, there is provided a table assembly comprising: a table top having an upper surface, a lower surface, and first and second ends; a table frame comprising a pair of first and second lateral frame structures for respectively receiving the first and second ends of the tabletop; and a securing post extending between the first and second lateral frame structures.

The tabletop may comprise a first component and a second component, the first and second components being secured to each other to form the tabletop. Preferably, the first and second ends of the tabletop comprise recesses to accommodate the table frame. The tabletop may be comprised of a plurality of substantially parallel slats.

In one embodiment, each of the first and second lateral frame structures of the table frame comprises a first leg and a second leg, each of the legs having a base portion and a top portion such that the first and second legs are releasably and pivotally connected to each other at or near the top portions thereof, the base portions defining a space therebetween so that each of the lateral frame structures has an A frame configuration. Further, the first and second lateral frame structures may comprise a plurality of cross pieces extending between the first and second legs, and there are preferably four cross pieces. In one form, each of the four cross pieces has a fixed end and a connectable end, two of the four cross pieces have their fixed ends connected pivotally at positions along the length of the first leg, and the other two of the four cross pieces having their fixed ends connected pivotally at positions along the length of the second leg. The two cross pieces having their fixed ends connected to the first leg may have their connectable ends releasably fastened to the second leg, and the other two cross pieces having their fixed ends connected to the second leg have their connectable ends releasably fastened to the first leg.

The table assembly may further comprise connector brackets connectable to the first leg and the second leg, the connector brackets comprising a support surface for the tabletop. In one embodiment, there are four connector brackets, each connector bracket being fastened to one of the first and second legs of the first and second lateral frames. The connector brackets may be releasably connectable to the first leg and the second leg of each of the first and second lateral frames.

In one embodiment, the first and second ends of the tabletop are received and held in a substantially horizontal position by the first and second lateral frame structures between the base portion and the top portions of the first leg and the second leg.

In another embodiment, the first and second ends of the tabletop are received and held in a substantially horizontal position by the first and second lateral frame structures at a point substantially equidistant from the base portion and the top portions of the first leg and the second leg.

The tabletop, table frame and securing post may be collapsible for compacted storage within a container.

The table assembly may further comprise support bars for providing additional support to the tabletop, the lower surface of the tabletop resting upon the support bars.

The cross piece may be of a length customized to fit between a selected space between the first and second legs of the first and second lateral frame structures, or it may have an adjustable length which can be configured so as to occupy a selected space between the first and second legs of the first and second lateral frame structures, or it may have a plurality of apertures along its length, wherein one of the plurality of apertures is selected for fixing the cross piece to the first or second leg of the first or second lateral frame structure.

According to a further aspect of the invention, there is provided a method of assembling a table comprising: providing a table top having an upper surface, a lower surface, and first and second ends; attaching the tabletop to a table frame comprising a pair of first and second lateral frame structures for respectively receiving the first and second ends of the tabletop; and securing the first and second lateral frame structures to each other by means of a securing post.

In yet a further aspect of the invention, there is provided a table assembly comprising: a table top having an upper surface, a lower surface, and first and second ends; and a table frame comprising a pair of first and second lateral frame structures for respectively receiving the first and second ends of the tabletop.

The table assembly in accordance with the invention therefore typically comprises a substantially horizontal surface for use as a table, and a pair of supports which preferably engage with and support the side edges of the table.

The horizontal surface may be comprised of slats, and may be modular in that it may comprise two or more sections which correspond with and fit together with each other.

In one aspect of the invention, the pair of supports are generally A shaped, comprising a pair of posts joined together and having a wider base, and tapering towards the top. The A shaped posts may have crossbeams extending between them so as to provide additional stability and support to the structures. The number of crossbeams may be selected according to need, but may typically comprise between three and five crossbeams, and preferably four such crossbeams in one of the embodiments.

The crossbeams may also serve as a support for the horizontal surface, each end of the horizontal surface being configured so as to attach to one of the crossbeams on the supports.

A further beam, or beams, bracket or post may extend between the posts, to provide additional stability.

Preferably, the table assembly is of the knockdown variety, and can be assembled and disassembled according to need. Hardware may be provided for the purposes of securing the components together. One such arrangement includes two pieces of table top, four pieces of A frame, one connection bar, and four pieces of corner blocks. Leg frames may be provided, preferably of the foldable type, for attachment to and incorporation into the table assembly.

The entirety of components, hardware and associated products may be collapsible and storable relative to each other in a carton for storage and transportation.

BRIEF DESCRIPTION OF THE DRAWINGS

In the drawings:

FIG. 12 shows a tabulated description of the parts of the table assembly and dimensions in accordance with one aspect of the invention; and FIG. 13 shows a tabulated description of the parts of the table assembly and dimensions in accordance with a further aspect of the invention.

DETAILED DESCRIPTION OF THE INVENTION

Reference is made to the accompanying drawings which shows various embodiments of the table assembly in accordance with the invention. These drawings illustrate the assembled table assembly of the invention, as well as the various components which make up the table assembly. The drawings also illustrate exploded views and details of components of the table assembly, and preferred measurements and dimensions, although the invention is not limited thereto.

It is to be noted that the embodiments described and illustrated herein are examples of the invention, and modifications in shape, construction, size and other elements may be made to the table assembly of the invention, falling within the scope thereof.

Figure 1:
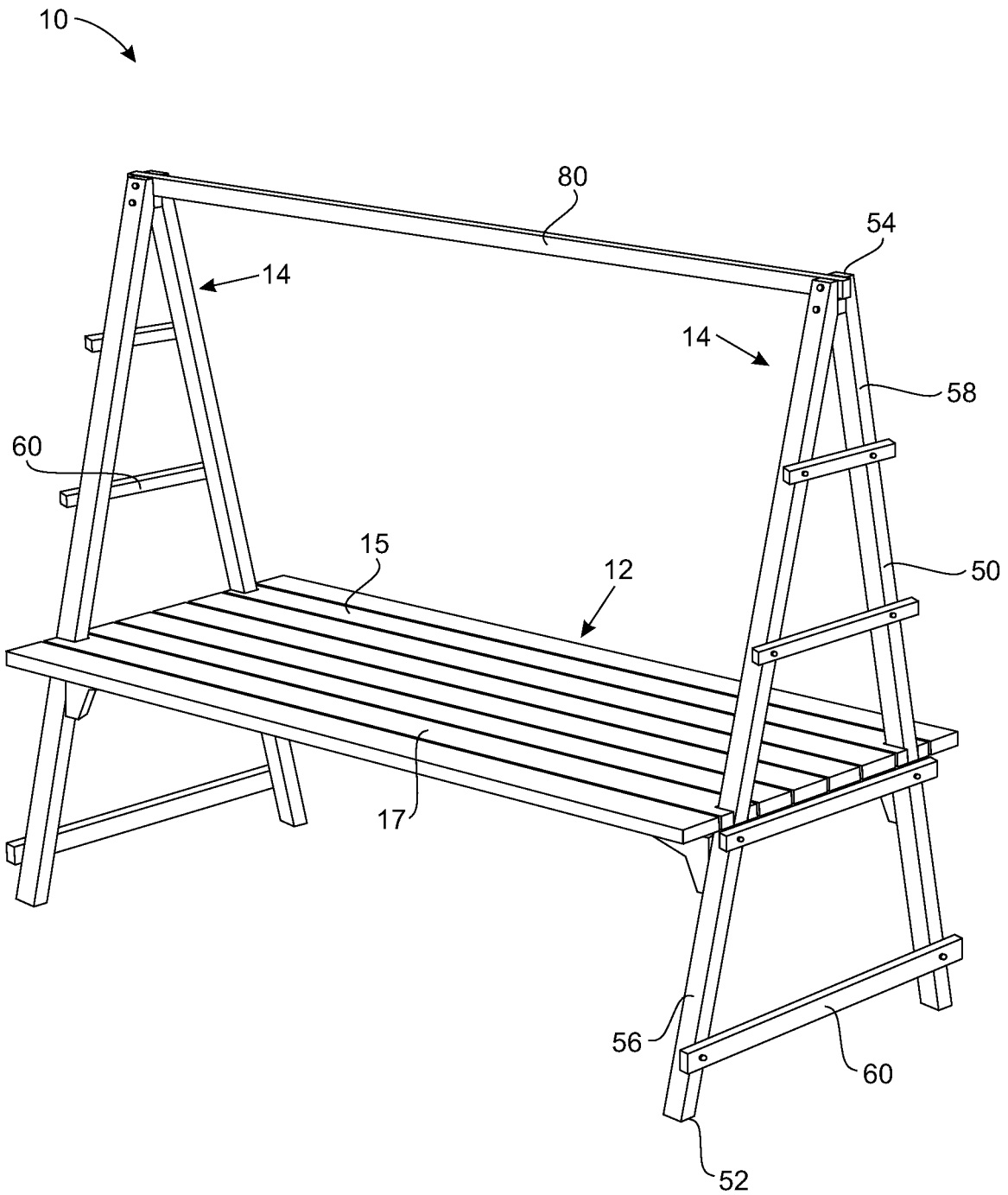
FIG. 1 is a perspective view of a table assembly having components and constructed in accordance with one aspect of the invention.
Figure 2:
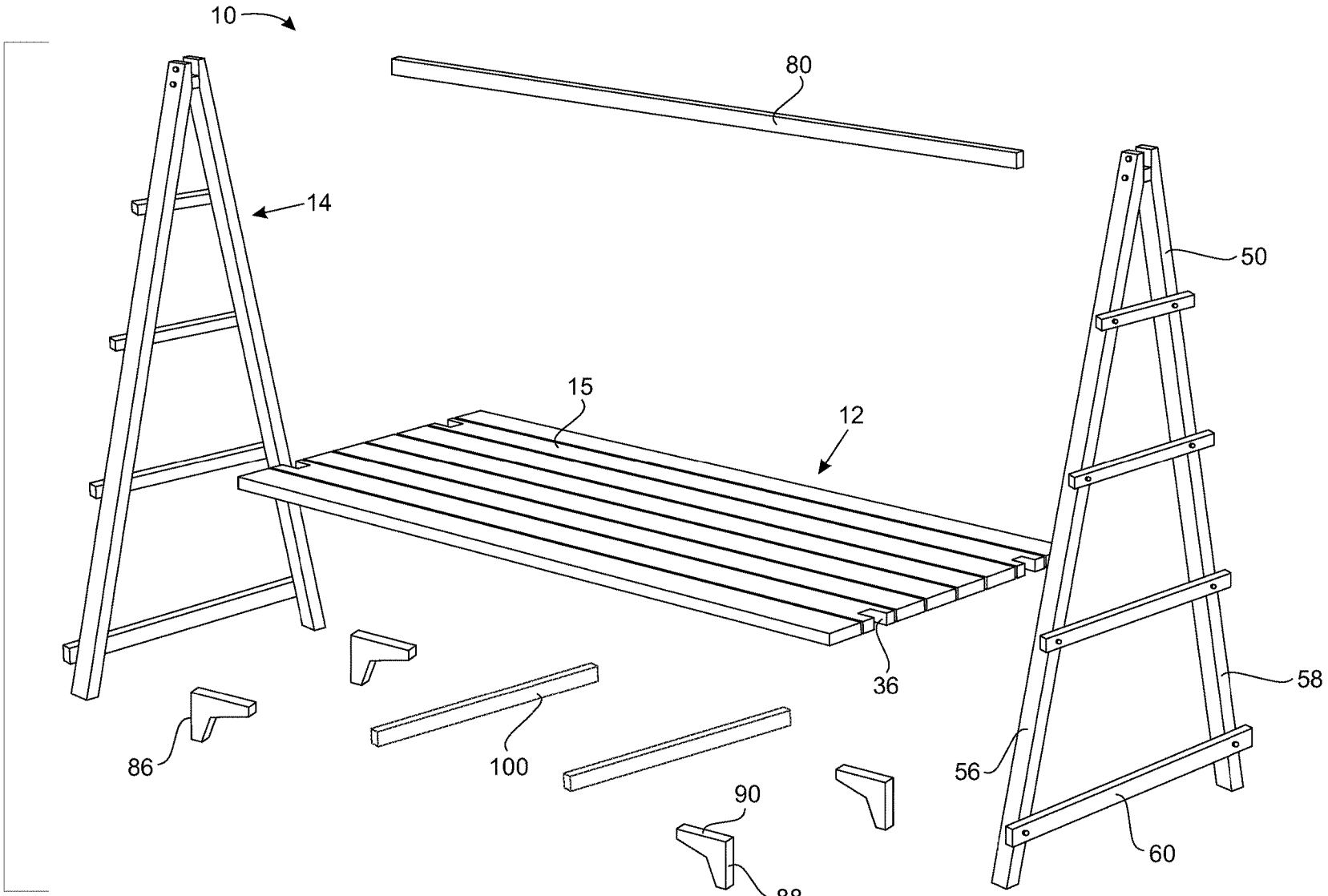
FIG. 2 is an exploded perspective view of the table assembly of the invention showing the various parts and components thereof.
Figure 3:
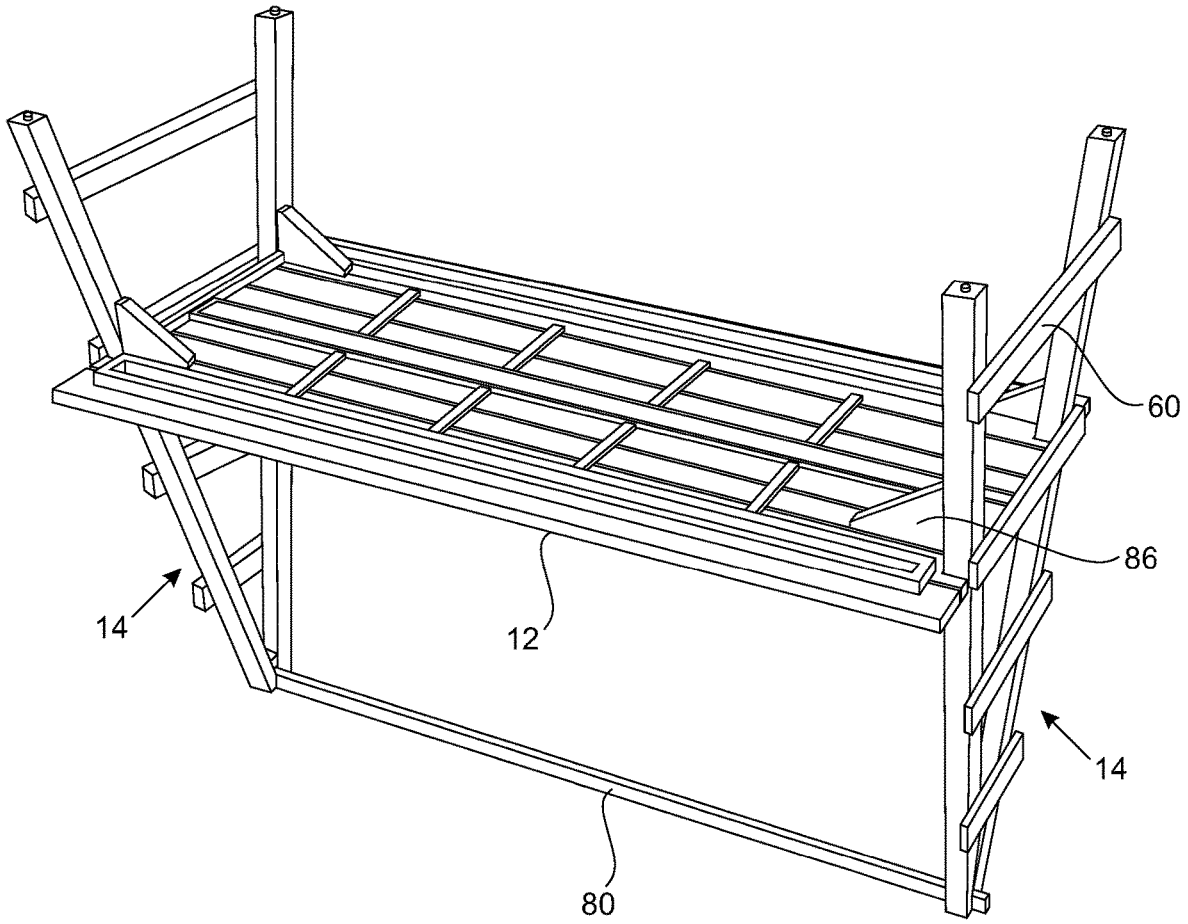
FIG. 3 is a bottom perspective view of the table assembly in accordance with one aspect of the invention.

FIG. 1 of the drawings, there is shown a table assembly 10. The table assembly 10 is comprised of a table surface 12 and a table frame 14. The table surface 12 has an upper surface 15 and a lower surface 16. The table surface 12 in the present embodiment is comprised of a plurality of parallel slats 17, and a framework 18 on which the slats 17 are mounted. The framework 18 includes a pair of opposing longitudinal posts 20 and a plurality of horizontal posts 22 extending along the length of the table surface 12 below the lower surface 16.

In the present embodiment, the table surface 12 is comprised of a first component 26 and a second component 28. However, the table surface 12 may be, in other embodiments, comprised of only a single component, or more than two components. The number of components may be determined by the size, including width, of the table surface 12, or by any other factor relevant to this construction.

The first component 26 and the second component 28 have ends 32 and 34 respectively. Each of the ends 32 and 34 includes a niche or recess 36, the niche or recess 36 being positioned on the respective ends 32 and 34 so as to receive therewithin a portion of the table frame 14, as will be described in further detail below.

Note that, in another embodiment, the table surface 12 may be comprised of a single piece or component, as opposed to a plurality of slats 17, and may also have the niche or recesses 36 positioned on the ends thereof so as to receive and accommodate the table frame 14.

Figure 7:
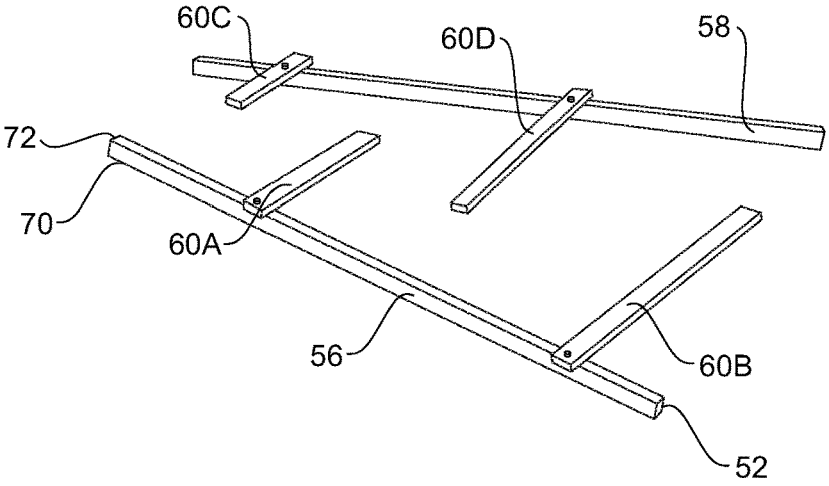
FIG. 7 is a perspective exploded view of a part of the frame for a table assembly constructed in accordance with the present invention.
Figure 8:
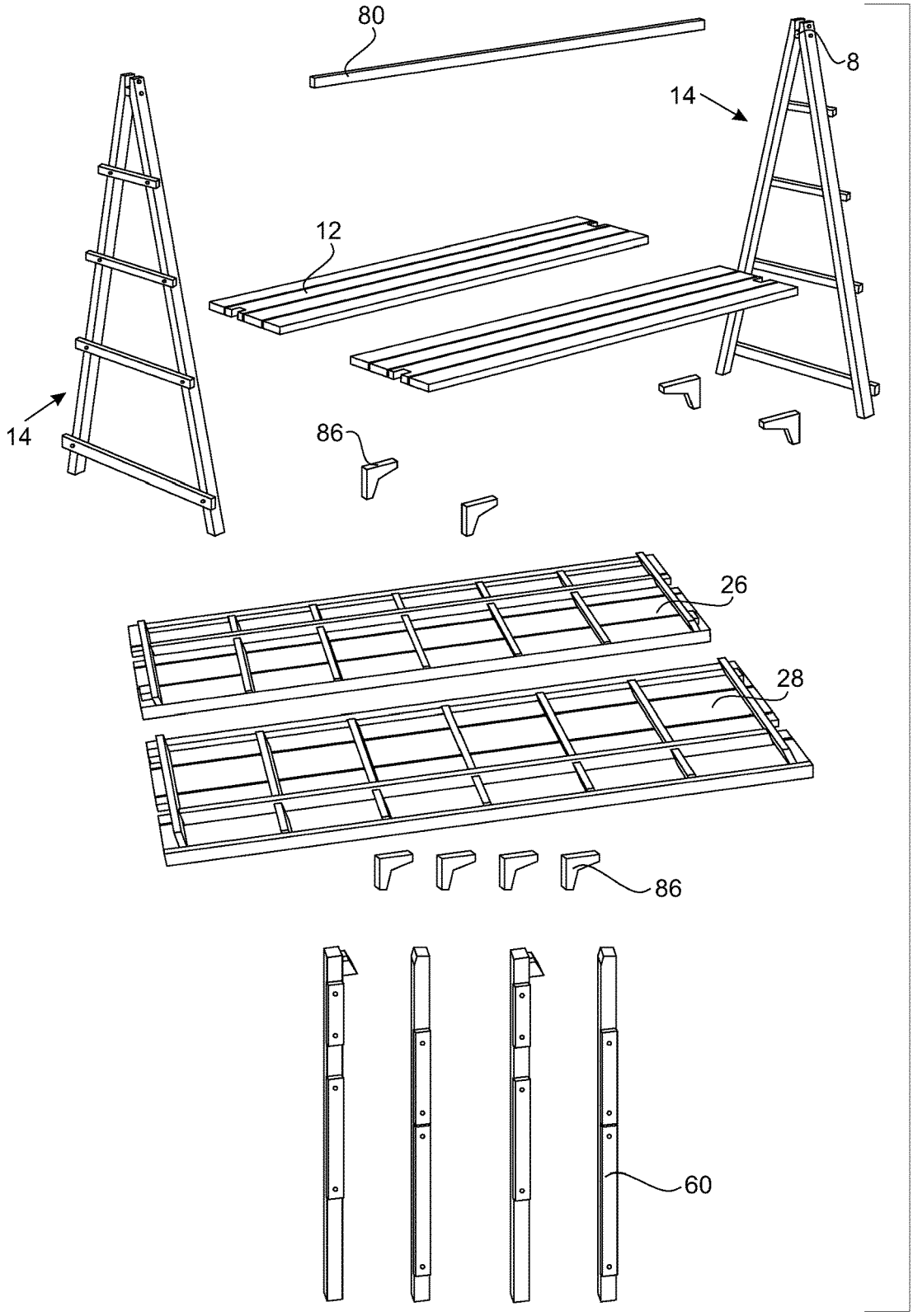
FIG. 8 shows components of the table assembly in accordance with the invention, in relation to each other and also as they may be packed for storage or transportation within a container.
Figure 9:
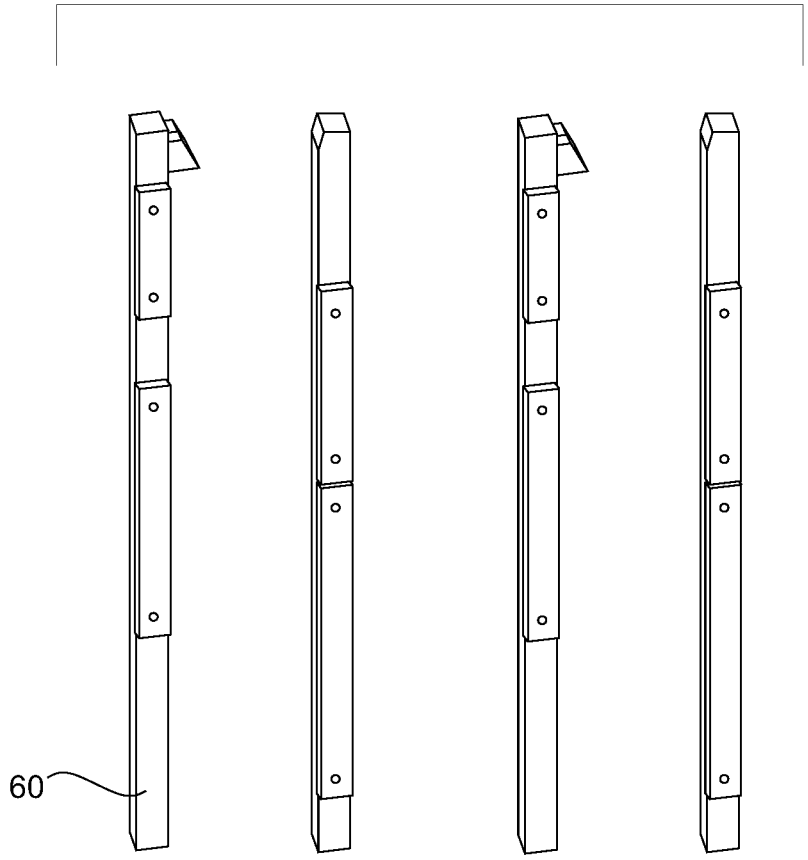
FIG. 9 is a detail of the cross piece components which are used to form a portion of the frame of the table assembly of the invention.

The table frame 14 may, in a preferred embodiment, comprise and A frame 50 having a wider base 52 tapering to a narrow top 54. The A frame 50 comprises a first leg 56 and a second leg 58, and a series of cross pieces 60 extending in a generally horizontal plane between the first leg 56 and the second leg 58 of the A frame 50. In one embodiment, the A frame 50 comprises four cross pieces 60. As seen clearly in FIG. 7 of the drawings, two cross pieces 60A and 60B are pivotally connected to the first leg 56, while two cross pieces 60C and 60D are pivotally connected to the second leg 58. The cross pieces 60A, 60B, 60C and 60D are arranged in a staggered or spaced relationship on the first leg 56 and second leg 58 respectively so that each of such cross pieces will occupy a different horizontal plane or position with respect to the others. Preferably, but not necessarily, each of the cross pieces 60A, 60B, 60C and 60D are of substantially equal distance from each other in a horizontal plane when the A frame 50 is in the constructed or assembled position.

Each leg 56 and 58 of the A frame 50 has a top end 70 and 72 respectively which are pivotally connected to each other, or connected by a hinge, when the legs 56 and 58 are in the assembled position. Cross pieces 60A and 60B are fixed pivotally to the first leg 56, while the cross pieces 60C and 60D are fixed pivotally to the second leg 58. When assembled, the non-fixed ends of the cross pieces 60A and 60B of the first leg 56 are releasably connected at predetermined points along the height of the second leg 58. Likewise, the non-fixed ends of the cross pieces 60C and 60D are releasably connected at predetermined points along the height of the first leg 56.

Each of the cross pieces 60A, 60B, 60C and 60D may have an adjustable length, so that a cross piece near the top of the A frame 50 may be adjusted to have a shorter length, while a cross piece near the bottom of the A frame 50 may be adjusted to have a longer length. There are numerous different ways in which the cross pieces 60A, 60B, 60C and 60D can be constructed so that a shorter length cross piece may be used near the top of the A frame 50, and a longer length cross piece may be used near the bottom of the a frame 50. Some possibilities include cross pieces which have shorter and longer lengths, cross pieces which can fold or even telescope to an appropriate and selected length, cross pieces which have apertures or connection points along their length so that any given cross piece can be connected to the A frame 50 by selecting the appropriate apertures, a combination of any of the above, or a different mechanism entirely.

The A frame 50 is assembled by connecting the first leg 56 and second leg 58 to each other, near the top ends 70 and 72. This is achieved by orienting the first leg 56 and second leg 58 alongside each other, and then pivotally or by means of a hinge connecting each of the legs 56 and 58 at the narrow top 54 using a bolt, pin or other such connecting member. The cross pieces 60A and 60B are pivoted at their fixed end on the first leg 56 so that the non-fixed end of these cross pieces 60A and 60B are generally horizontal, and wherein an aperture at the non-fixed ends of these cross pieces 60A and 60B registers with an aperture or other structure on the second leg 58 configured and positioned for properly receiving the respective cross pieces 60A and 60B. The same procedure is followed in connecting the cross pieces 60C and 60D, which are pivotally fixed on the second leg 58, to the first leg 56. Any convenient or mechanically effective mechanism or structure may be used to fasten the non-fixed ends of the cross pieces 60A, 60B, 60C and 60D. Such connection is preferably a secure but readily releasable one so that the A frame 50 can be conveniently disassembled for storage or transportation. Such fastening mechanisms may include bolts or pins as described above, or brackets, hooks, clamps, or any other suitable structure.

A pair of A frames 50, assembled as set forth above, are constructed, each one of the pair of forming a base or frame 14. The pair of A frames 50 are located with respect to each other so as to be facing each other, at a distance which is substantially equivalent to the width of the table surface 12. A connection bar 80, which is also configured so as to be of a length substantially equivalent to that of the table surface 12, is releasably connected to the opposing pair of A frames 50 at or near the narrow top 54 of each of the A frames 50, as seen in several of the figures. The connection bar 80 ensures that the A frames 50 remained in fixed relative positions, and provides additional stability and strength to the table assembly 10 of the invention when in the assembled position.

In this embodiment, four generally identical support brackets 86 are provided. The support brackets 86 include a connection portion 88 which allows the support bracket 86 to be attached to either of the first leg 56 and second leg 58 of the A frame 50. The support brackets 86 further comprise a support portion or surface 90, the support portion 90 essentially comprising a substantially horizontal flat receiving surface upon which the edges or end 32 and 34 of the table surface 12 may be located. While, in one embodiment, the table surface 12 will always be received and accommodated at the same location along the height of the A frame 50, other embodiments of the invention may facilitate the connection of the support brackets 86 at selected predetermined length along the first leg 56 and the second leg 58 so that the height of the table surface 12 can be varied according to the requirements and preferences of the user. In such a case, the first and second legs 56 and 58 respectively will have multiple points at which the support bracket 86 can be releasably fastened thereto, so that the height of the will of course depend upon which connection point along the legs 56 and 58 has been selected by the user. In a further embodiment, the support brackets 86 may comprise clamp like mechanisms or fasteners which enable them to be attached to either one of the legs 56 and 58 at any selected point along their lengths.

As noted above, the table surface 12 has niches or recesses 36 at the ends 32 and 34 thereof. When the table surface 12 is assembled onto the A frame 50, these recesses 36 correspond to the position of the first leg 56 and the second leg 58 respectively so that the first leg 56 and second leg 58 are each received within its corresponding recess 36 on the table surface 12. This not only provides additional stability, but also enables the table surface 12 to extend to a small degree beyond the point which would otherwise be possible, providing additional length to the table surface 12.

Figure 4:
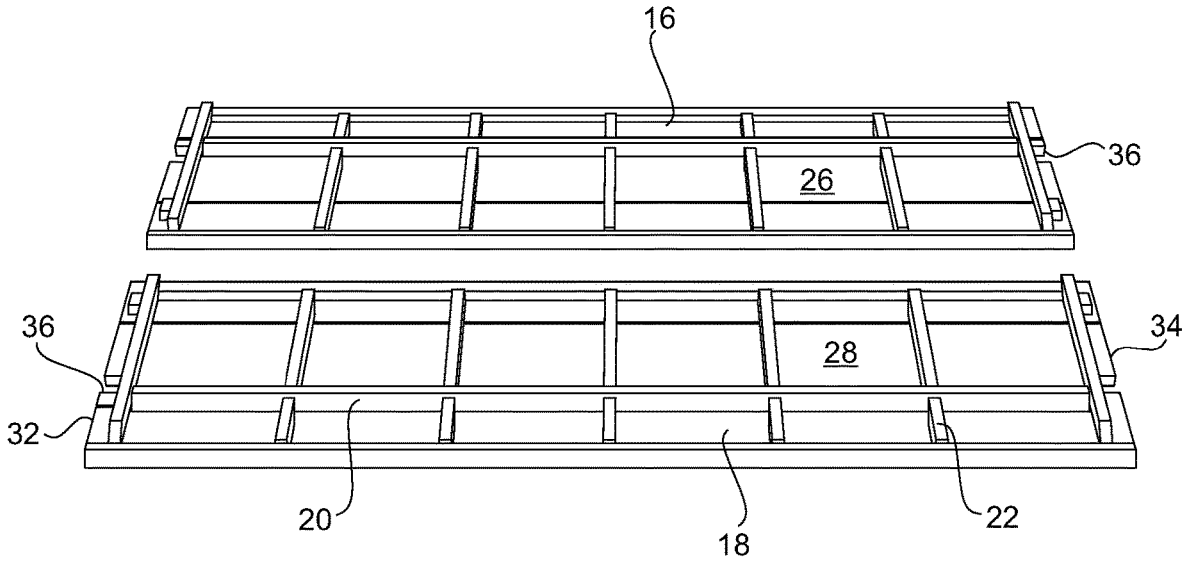
FIG. 4 is a bottom perspective view of a table surface forming a part of the table assembly, shown in this embodiment as comprising two parts.
Figure 5:
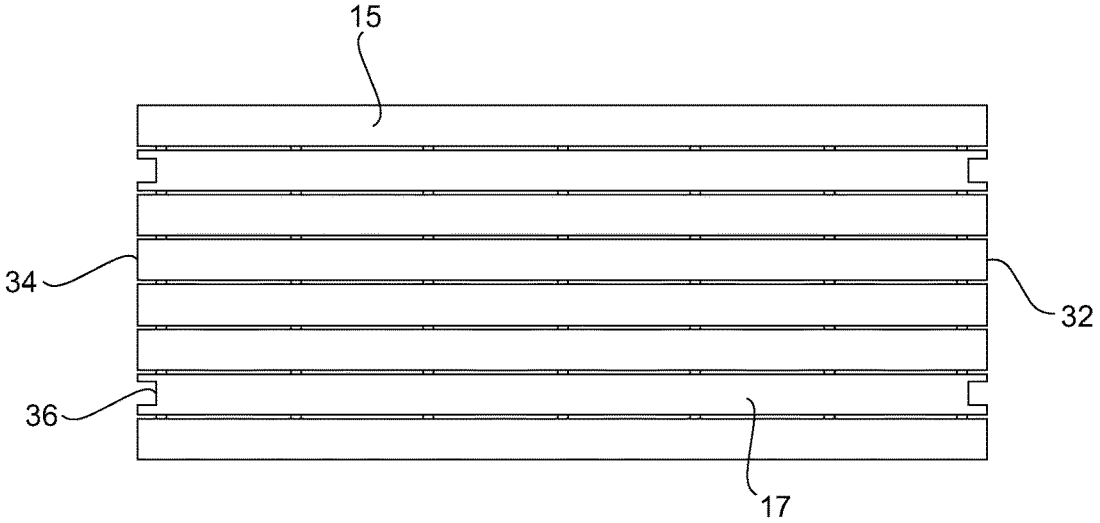
FIG. 5 is a top view of a table surface forming a part of the table assembly.
Figure 6A:
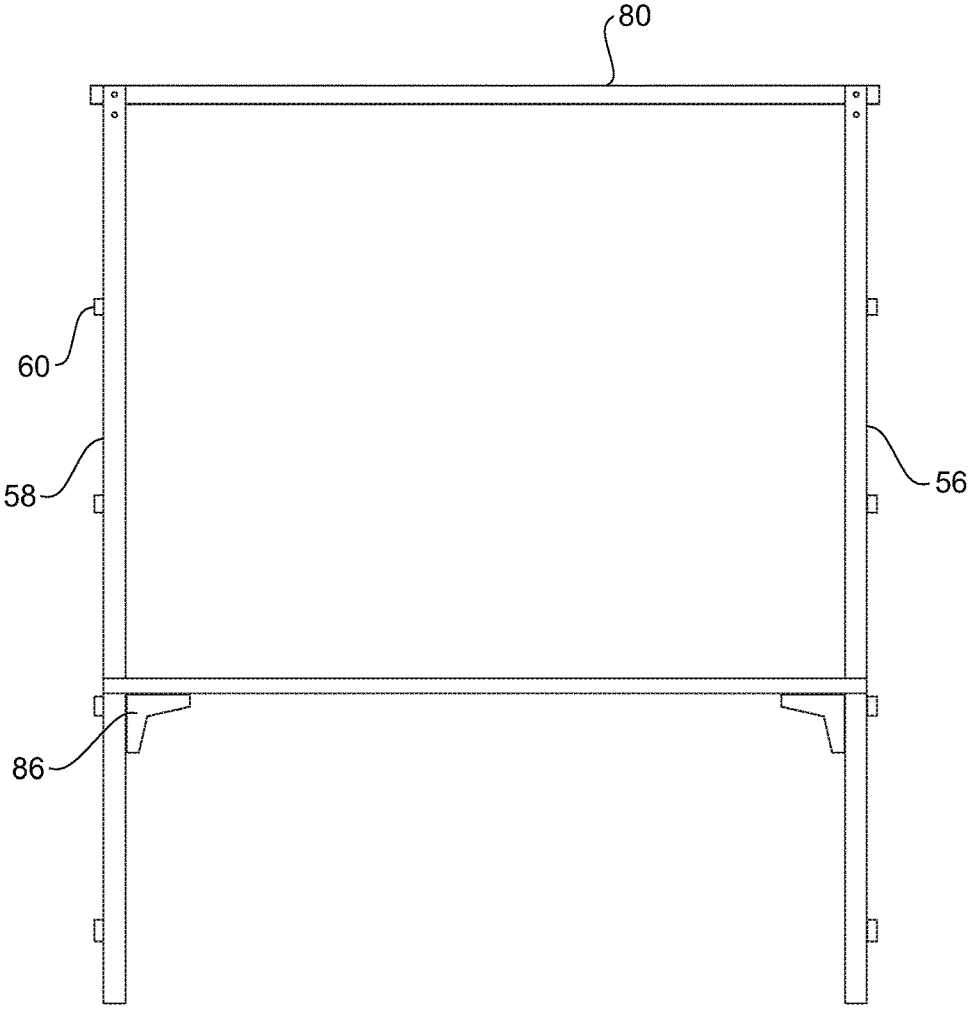
FIG. 6A is a front view of a table assembly in accordance with the present invention.
Figure 6B:
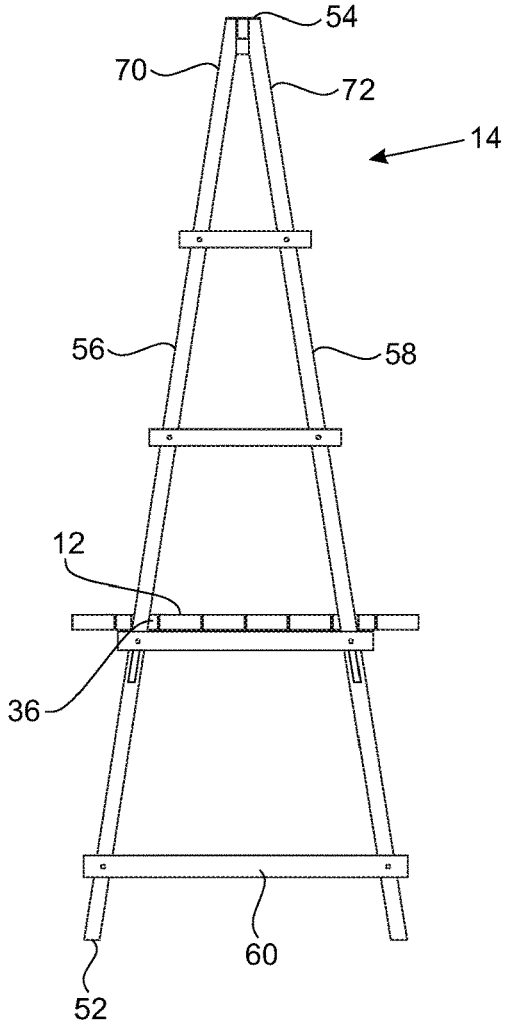
FIG. 6B is a side view of a table in accordance with the present invention.

A pair of support bars 100 are additionally provided for additional support and stability. Further, the first component 26 and the second component 28 of the table surface may be secured to each other by bolts or other hardware through registering apertures as shown, such as in FIG. 4, in order to hold them securely together. These first and second components 26 and 28 may of course once more be separated, when needed, and the ability to split the table surface 12 into two first and second components 26 and 28 facilitates a smaller footprint in terms of the packaging box or carton required, allowing for a smaller and hence more effective container size. This may make storage easier, and may also save on transportation costs since the various components of the table assembly can be located into a more standardized size container used by movers.

Figure 10:
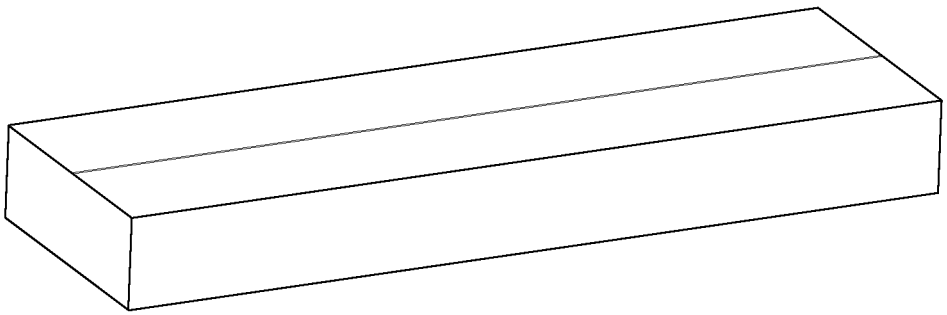
FIG. 10 illustrates a perspective view of a carton or container in which the components of the table assembly may be accommodated during storage and transportation.
Figure 11:
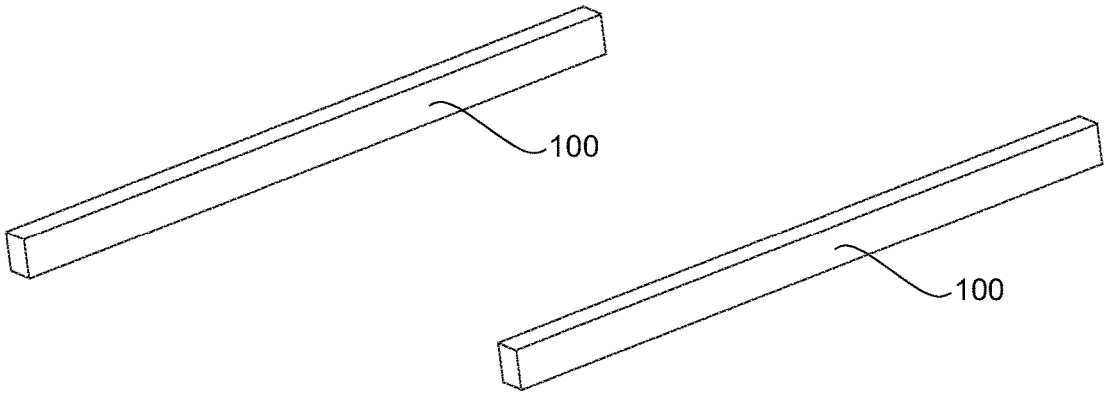
FIG. 11 is a perspective view of a pair of support bars used to mount and stabilize the table surface of a table assembly of the invention.

FIG. 10 of the drawings illustrates a typical carton 106 into which all of the components of the table assembly 12 can be packed.

While specific embodiments have been illustrated herein, it will be appreciated that variations are possible within the scope of the invention. For example, the tabletop surface may be of any desired shape and size, and may be subdivided into smaller components connectable to each other during assembly. The end frames, shown as a frames in the figures illustrated here in, may be of different shape and size as well. These frames may be square, rectangular, frustoconical, trapezoid the like. The connection bar 80 may be omitted if other connection points are made strong enough to provide the necessary stability.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A table assembly comprising:

a table top having an upper surface, a lower surface, and first and second ends, the table top having a first component and a second component each of which has an upper part surface, an inner side edge and an outer side edge, the first component and second component being substantially identical and connected to each other such that the inner side edge of each of the first and second components are laterally adjacent each other so that upper part surface of the first component and the upper part surface of the second component are continuous and coplanar and define the upper surface of the table top;

a table frame comprising a pair of first and second lateral frame structures for respectively receiving the first and second ends of the tabletop, wherein the first and second ends of the tabletop comprise recesses to accommodate the table frame;

a plurality of substantially horizontal cross pieces extending between the first and second lateral frames, each cross piece having a first fixed end pivotally attached to the first or second lateral frame structure and a second detachable end releasably attached to the second or first lateral frame structure respectively; and a securing post extending between the first and second lateral frame structures.

2. A table assembly as claimed in claim 1 wherein each of the first and second lateral frame structures of the table frame comprises a first leg and a second leg, each of the legs having a base portion and a top portion such that the first and second legs are releasably and pivotally connected to each other at or near the top portions thereof, the base portions defining a space therebetween so that each of the lateral frame structures has an A frame configuration.

3. A table assembly as claimed in claim 2 wherein the first and second ends of the tabletop are received and held in a substantially horizontal position by the first and second lateral frame structures at a location between the base portion and the top portions of the first leg and the second leg.

4. A table assembly as claimed in claim 3 wherein the first and second ends of the tabletop are received and held in a substantially horizontal position by the first and second lateral frame structures at a point substantially equidistant from the base portion and the top portions of the first leg and the second leg.

5. A table assembly as claimed in claim 1 comprising four cross pieces.

6. A table assembly as claimed in claim 5 wherein two of the four cross pieces have their fixed ends connected pivotally at positions along the length of the first leg, and the other two of the four cross pieces having their fixed ends connected pivotally at positions along the length of the second leg.

7. A table assembly as claimed in claim 6 wherein the two cross pieces having their fixed ends connected to the first leg have their connectable ends releasably fastened to the second leg, and the other two cross pieces having their fixed ends connected to the second leg have their connectable ends releasably fastened to the first leg.

8. A table assembly as claimed in claim 1 further comprising connector brackets connectable to the first leg and the second leg, the connector brackets comprising a support surface for the tabletop.

9. A table assembly as claimed in claim 8 wherein there are four connector brackets, each connector bracket being fastened to one of the first and second legs of the first and second lateral frames.

10. A table assembly as claimed in claim 8 wherein the connector brackets are releasably connectable to the first leg and the second leg of each of the first and second lateral frames.

11. A table assembly as claimed in claim 1 wherein the tabletop, table frame and securing post are collapsible for compacted storage within a container.

12. A table assembly as claimed in claim 1 further comprising support bars for providing additional support to the tabletop, the lower surface of the tabletop resting upon the support bars.

13. A table assembly as claimed in claim 1 wherein at least one of the cross pieces is of a length customized to fit between a selected space between the first and second legs of the first and second lateral frame structures.

14. A table assembly as claimed in claim 1 wherein at least one of the cross pieces has an adjustable length which can be configured so as to occupy a selected space between the first and second legs of the first and second lateral frame structures.

15. A table assembly as claimed in claim 1 wherein at least one of the cross pieces has a plurality of apertures along its length, wherein one of the plurality of apertures is selected for fixing the cross piece to the first or second leg of the first or second lateral frame structure.

16. A table assembly comprising:

a table top having an upper surface, a lower surface, and first and second ends, the table top having a first component and a second component each of which has an upper part surface, an inner side edge and an outer side edge, the first component and second component being substantially identical and connected to each other such that the inner side edge of each of the first and second components are laterally adjacent each other so that upper part surface of the first component and the upper part surface of the second component are continuous and coplanar and define the upper surface of the table top, wherein the tabletop is comprised of a plurality of substantially parallel slats;

a table frame comprising a pair of first and second lateral frame structures for respectively receiving the first and second ends of the tabletop;

a plurality of substantially horizontal cross pieces extending between the first and second lateral frames, each cross piece having a first fixed end pivotally attached to the first or second lateral frame structure and a second detachable end releasably attached to the second or first lateral frame structure respectively; and a securing post extending between the first and second lateral frame structures.

17. A table assembly comprising:

a table top having an upper surface, a lower surface, and first and second ends, the table top having a first component and a second component each of which has an upper part surface, an inner side edge and an outer side edge, the first component and second component being substantially identical and connected to each other such that the inner side edge of each of the first and second components are laterally adjacent each other so that upper part surface of the first component and the upper part surface of the second component are continuous and coplanar and define the upper surface of the table top;

a table frame comprising a pair of first and second lateral frame structures for respectively receiving the first and second ends of the tabletop;

a plurality of substantially horizontal cross pieces extending between the first and second lateral frames, each cross piece having a first fixed end pivotally attached to the first or second lateral frame structure and a second detachable end releasably attached to the second or first lateral frame structure respectively, wherein at least one of the cross pieces has an adjustable length which can be configured so as to occupy a selected space between the first and second legs of the first and second lateral frame structures; and a securing post extending between the first and second lateral frame structures.

* * * * *